US005517698A

United States Patent [19]

Nault et al.

[11] Patent Number: 5,517,698

[45] Date of Patent: May 21, 1996

[54] BICYCLE HELMET

[76] Inventors: Thomas R. Nault; Vicki L. Nault, both of 8328 West Ave. E-12, Lancaster, Calif. 93536

[21] Appl. No.: 304,126

[22] Filed: Sep. 12, 1994

[51] Int. Cl.[6] ..... A42B 3/00

[52] U.S. Cl. ..... 2/424; 2/425

[58] Field of Search ..... 2/410, 411, 414, 2/421, 422, 423, 424, 425, 9, 417, 15, 10

[56] References Cited

U.S. PATENT DOCUMENTS

| | | | |
|---|---|---|---|
| 3,665,514 | 5/1972 | Durand | 2/422 X |
| 4,357,711 | 11/1982 | Drefko et al. | 2/422 X |
| 4,507,809 | 4/1985 | Stepan | 2/424 |
| 4,748,696 | 6/1988 | Fohl | 2/424 |
| 5,010,598 | 4/1991 | Flynn et al. | 2/410 |
| 5,088,131 | 2/1992 | Kamata | 2/424 |
| 5,093,937 | 3/1992 | Kamata | 2/424 |
| 5,157,794 | 10/1992 | Kamata | 2/424 |

FOREIGN PATENT DOCUMENTS

| | | | |
|---|---|---|---|
| 497032 | 8/1992 | European Pat. Off. | 2/411 |
| 2566632 | 1/1986 | France | 2/411 |
| 3700737 | 7/1987 | Germany | 2/410 |
| 2061696 | 5/1981 | United Kingdom | 2/410 |

*Primary Examiner*—Michael A. Neas

[57] ABSTRACT

A bicycle helmet having a rigid shell, including a polymeric shell liner. The shell liner arranged to selectively receive at least one liner strip employing hook and loop fastener structure to provide for adjustment of the rigid shell onto an individual. A removable chin guard and pivotal visor is mounted to the rigid shell, with the visor including a visor rib arranged for securement in a raised orientation, with the visor arranged for reception within a spring clip structure mounted to the rigid shell.

1 Claim, 4 Drawing Sheets

BICYCLE HELMET

TECHNICAL FIELD

The field of invention relates to bicycle helmet construction, and more particularly pertains to a new and improved bicycle helmet wherein the same is directed to the ease of accessory structure such as a visor and chin guard secured to the helmet construction.

BACKGROUND OF THE INVENTION

Helmet structures of various types for employment by bicycle riders is available in the prior art as indicated in U.S. Pat. No. 4,443,891 indicating a helmet structure having therethrough a cushion insert.

U.S. Pat. No. 5,023,958 directed to an aerodynamic bicycle helmet as in U.S. Pat. No. 4,903,350.

The prior art helmets have heretofore not provided adequate protection for convenience such as chin guards, visors, and the like in cooperation with the relatively light-weight helmet construction as employed with bicycle riders and to this end, the instant invention attempts to address this need.

SUMMARY OF THE INVENTION

The present invention relates to a light-weight bicycle helmet construction having a rigid shell capable of spring-back construction employing a polymeric liner. The liner is arranged to adheredly receive inserts to accommodate various sizes of individuals. A displaceable visor and removable chin guard construction is available with the present invention for employment of safety and convenience by a bicycle rider.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
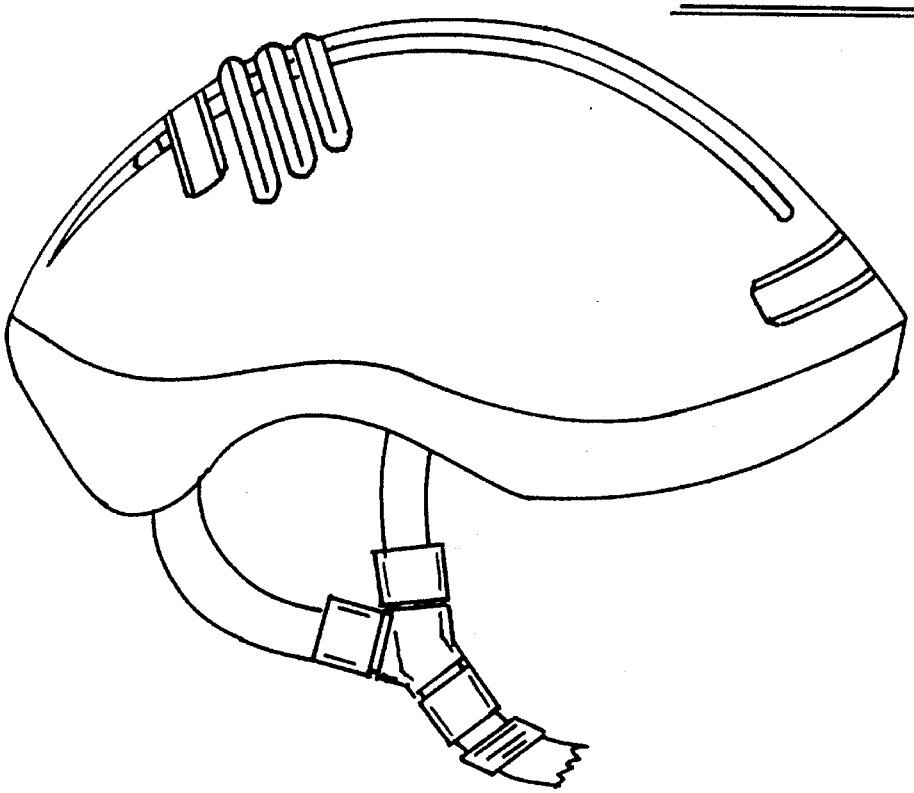
FIG 1 PRIOR ART
FIG. 1 is an orthographic view of a prior art bicycle helmet as indicated in U.S. Pat. No. 5,023,958.
Figure 2:
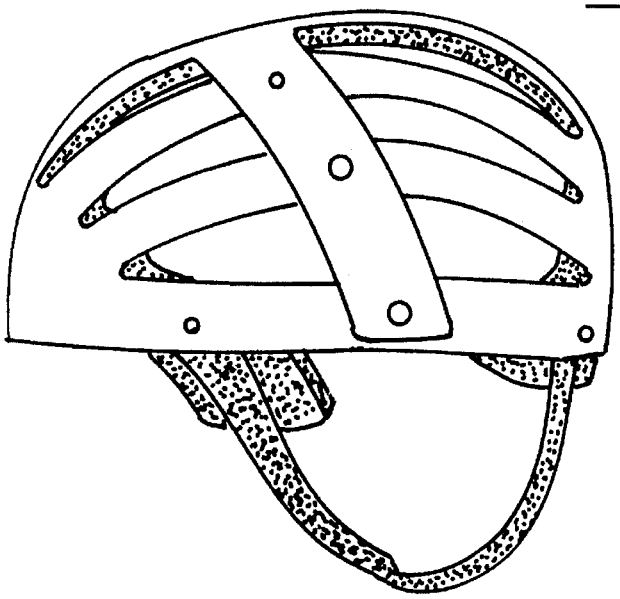
FIG 2 PRIOR ART
FIG. 2 is a prior art bicycle helmet as indicated in U.S. Pat. No. 4,443,891.
Figure 3:
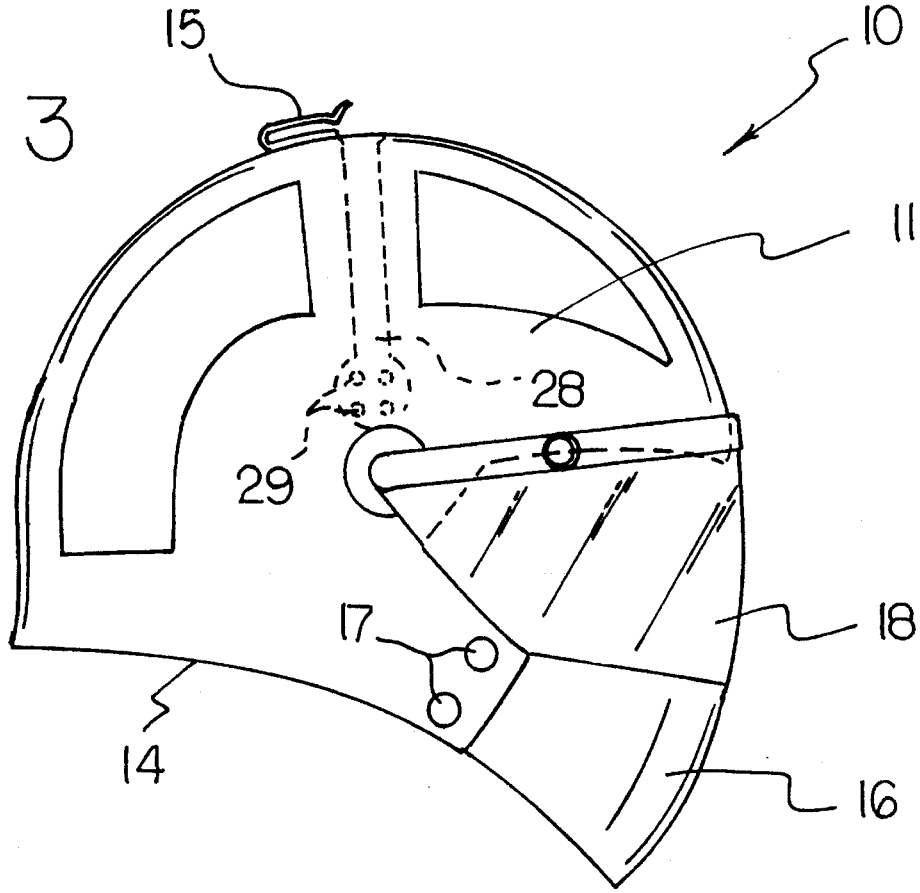
FIG. 3 is an orthographic side view of the invention.
Figure 4:
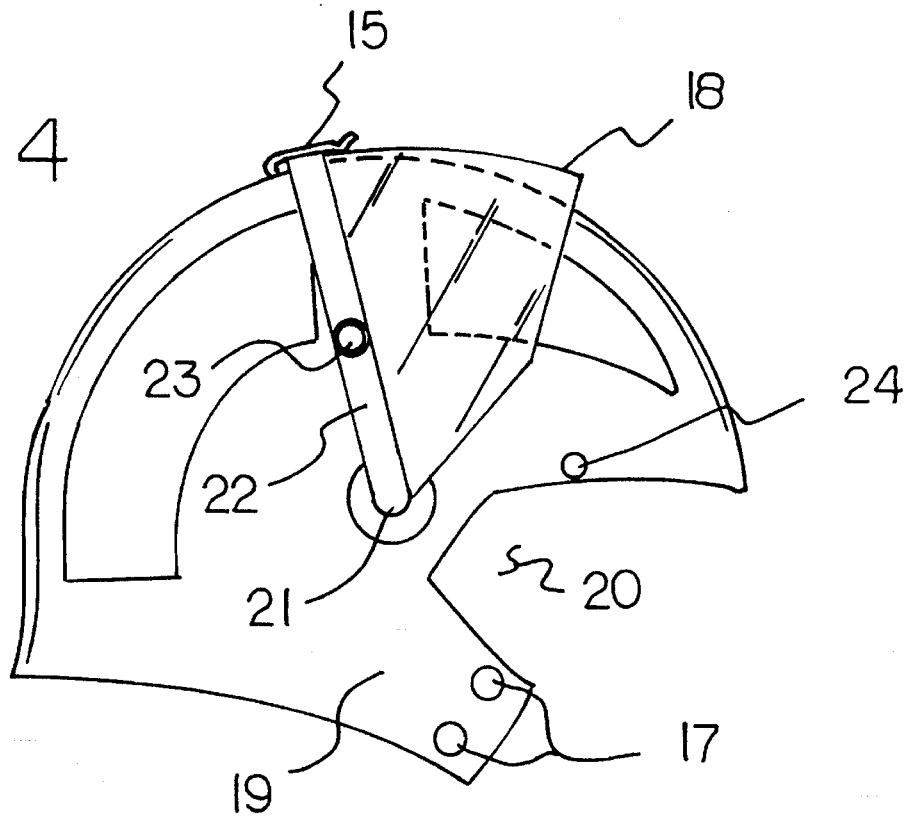
FIG. 4 is an orthographic side view of the invention with the visor in a raised orientation.
Figure 5:
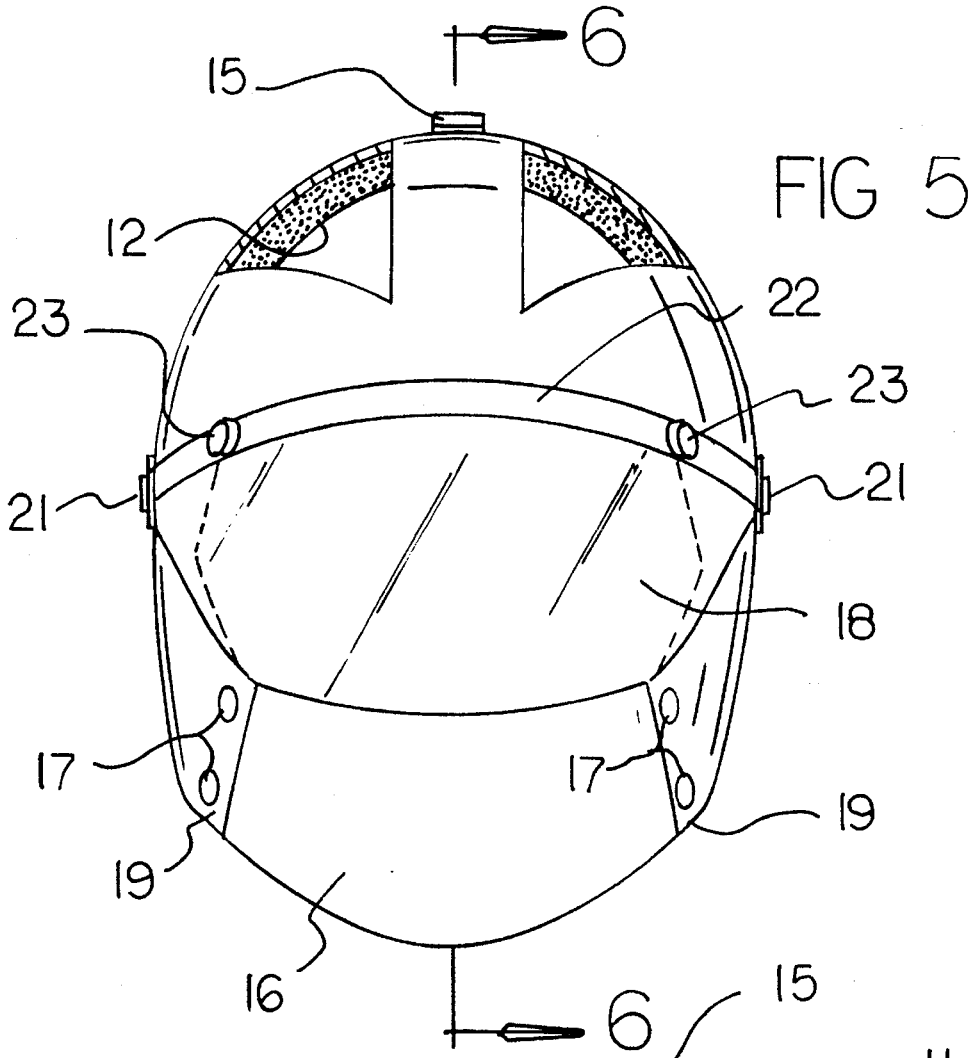
FIG. 5 is a frontal orthographic view of the invention.
Figure 6:
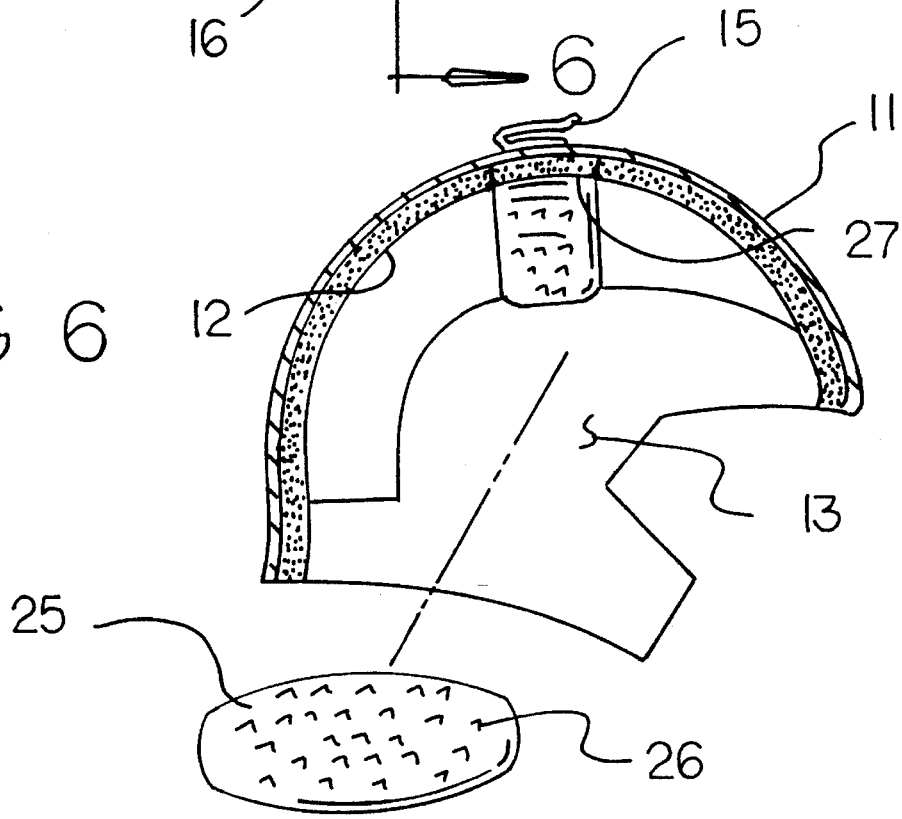
FIG. 6 is an orthographic view, taken along the lines 6—6 of FIG. 5 in the direction indicated by the arrows.
Figure 7:
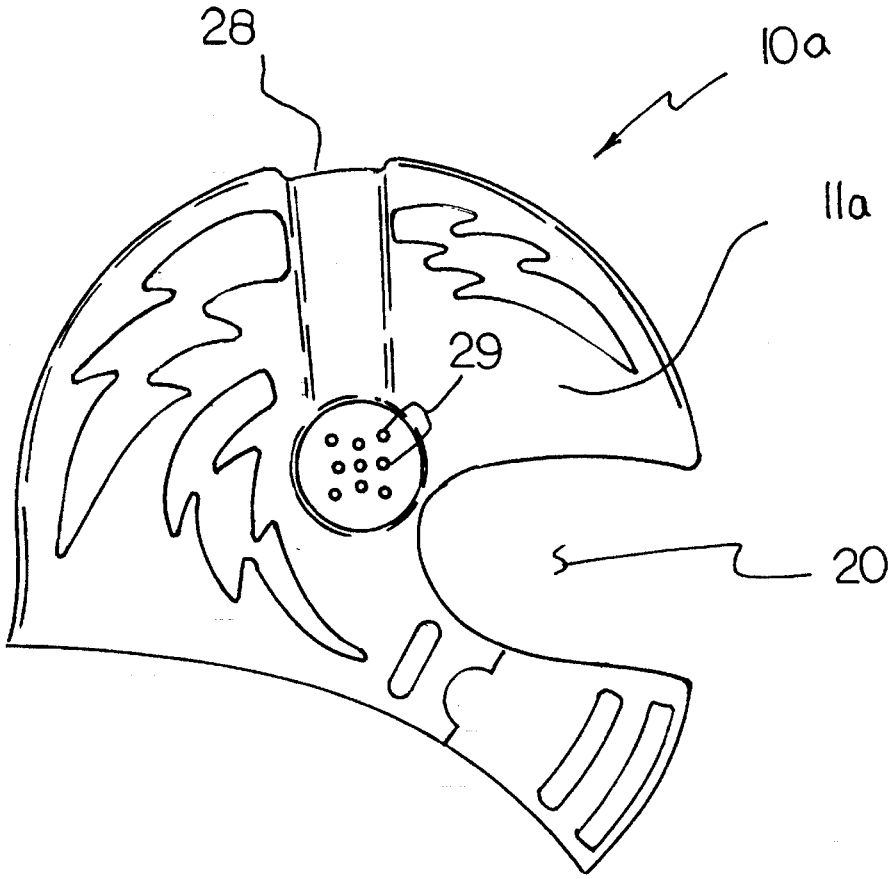
FIG. 7 is an orthographic view of a modified helmet construction of the invention.
Figure 8:
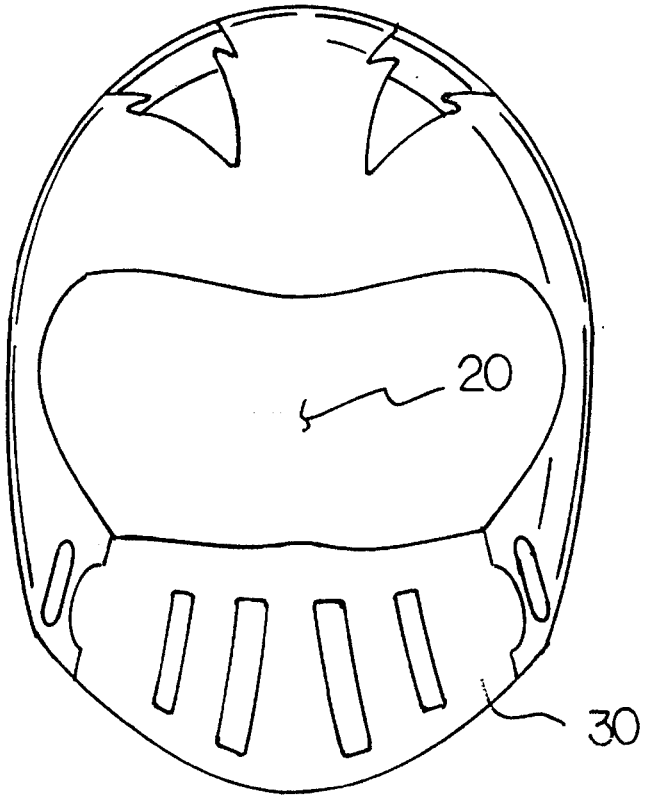
FIG. 8 is a frontal view of the modified helmet construction of the invention.

Construction 10 as indicated in FIG. 3 for example employs a rigid shell 11 to accommodate impact in use, with a polymeric liner 12 directed coextensively of the shell 11, such as indicated in FIG. 6 for example. The polymeric shell liner 12 defines a shell cavity 13. The rigid shell 11 terminates at a shell periphery 14, with a visor recess 20 directed into the periphery adjacent a facial portion of the shell, such that a transparent or at least translucent visor 18 is pivotally mounted to the rigid shell 11 about linearly aligned visor pivot axles 21. A U-shaped spring clamp 15 is mounted to the shell medially of the visor axles 21 to an uppermost surface of the rigid shell 11 to receive a visor rib 22 of the visor 18 when the visor is in a raised orientation, such as illustrated in FIG. 4, from a first lowered position as indicated in FIG. 3. In the lowered position, reciprocatable buttons 23 are each received within a respective button opening 24 directed into the rigid shell 11 adjacent the visor recess 20.

A chin guard projection of the rigid shell 11 is oriented adjacent and below the visor recess 20, having chin guard fasteners 17 to removably secure a U-shaped chin guard 16 thereto, as illustrated by the respective FIGS. 3 and 4, in the chin guard secured and removed orientation relative to the helmet construction 10.

The FIG. 6 indicates the provision of a liner strip 25 having hook fastener surface 26 arranged for adherence to a loop fastener surface 27 to permit the hook and loop fasteners to adhere relative to one another and in this manner selectively secure the liner strip 25 medially of the shell liner 12 to effect various sizing and accommodate individuals of various head sizings as a convenience and further readjust the position of the helmet onto an individual in use. The liner strip 25 is contained between the shell periphery 14 and is of a dimensionally smaller configuration than the shell liner to minimize weight and bulk in use of the helmet 10.

If so desired, a modified helmet 10*a* is illustrated such that a groove 28 extends from about an uppermost periphery of the shell liner 11 and terminates in at least one matrix of each openings 29, such that a head phone set (not shown) may be mounted within the groove 28, with the head phone audio portion oriented over the matrix of ear openings 29. A modified chin guard 30 is arranged for selective mounting to the shell 11, as illustrated. To this end, the helmet 10, as illustrated in FIG. 3 for example, may further employ the groove 28 extending about an exterior surface of the shell 11 terminating also in a matrix of each openings 29 adjacent each of the axles 21 as the groove 28 extends in approximately a one hundred fifty to one hundred eighty degree orientation about the shell 11 extending into a respective set of ear openings 29 adjacent the respective axle 21.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A bicycle helmet, comprising, a rigid shell, the rigid shell having an interim surface, the rigid shell further having a polymeric shell liner secured coextensively of the interior surface defining a shell cavity, the rigid shell having an exterior surface terminating in a shell periphery, with a plurality of chin guard projections extending coextensively and in a mirror image relationship relative to one another, with a visor recess extending into the rigid shell adjacent the chin guard projections, said shell having a plurality of button openings therein adjacent the upper portions of said visor recess, a visor of a generally U-shaped configuration, having a plurality of reciprocatable buttons on an upper edge thereof and positioned such that they engage the button openings in the shell when the visor is in a lowered position, the visor further having spaced end portions and each of said end portions having an axle extending into the rigid shell, and each said axle arranged in a linearly aligned relationship relative to one another;

a U-shaped spring clamp mounted to the exterior of the shell medially of said visor axles to receive a section of said visor when the visor is in a raised orientation, a groove extending into the exterior surface of the rigid shell, and the groove terminating in at least one matrix of ear openings oriented adjacent at least one of said axles, at least one liner strip, the liner strip having a first width, and the polymeric shell liner having a second width, wherein the first width is less than the second width, and the liner strip having a matrix of hook fastener members secured thereto, and the shell liner having a plurality of loop fasteners secured thereto for selective adherence to the hook fasteners.

* * * * *